US005404942A

United States Patent [19]

Patel

[11] Patent Number: 5,404,942

[45] Date of Patent: Apr. 11, 1995

[54] HEAT EXCHANGER AND METHOD OF MAKING THE SAME

[75] Inventor: Ramchandra L. Patel, Southgate, Mich.

[73] Assignee: Ford Motor Company, Dearborn, Mich.

[21] Appl. No.: 304,342

[22] Filed: Sep. 12, 1994

Related U.S. Application Data

[62] Division of Ser. No. 132,337, Oct. 6, 1993, Pat. No. 5,381,600.

[51] Int. Cl.[6] ..... F28F 1/42

[52] U.S. Cl. ..... 165/179; 165/151

[58] Field of Search ..... 165/151, 179; 29/890.044

[56] References Cited

U.S. PATENT DOCUMENTS

| | | |
|---|---|---|
| 3,467,180 | 9/1969 | Pensotti . |
| 3,517,536 | 6/1970 | Fitzmourice . |
| 4,004,441 | 1/1977 | Leszak . |
| 4,720,902 | 1/1988 | Gray . |
| 4,847,989 | 7/1987 | Franks . |
| 5,190,101 | 2/1993 | Jalilevand et al. . |

FOREIGN PATENT DOCUMENTS

| | | | |
|---|---|---|---|
| 2238543 | 2/1975 | France . | |
| 74153 | 6/1977 | Japan . | |
| 149737 | 11/1980 | Japan . | |
| 58-173043 | 10/1983 | Japan | 29/890.044 |
| 110435 | 6/1984 | Japan . | |
| 183326 | 3/1989 | Japan | 29/890.044 |
| 137609 | 5/1990 | Japan . | |

*Primary Examiner*—John C. Fox
*Attorney, Agent, or Firm*—Raymond L. Coppiellie; Roger L. May

[57] ABSTRACT

A method of making an automotive heat exchanger comprises the steps of assembling a heat exchanger core having a plurality of interleaved tube and fins disposed between a pair of endsheets and expanding the diameter of the tubes a predetermined distance by forcing an expansion tool therethrough. The tubes of the heat exchanger include a plurality of internal projections of predetermined height and the expansion process decreases the height of the projections by less than 25% of its original height. A heat exchanger formed in accordance with this method is also disclosed.

4 Claims, 2 Drawing Sheets

HEAT EXCHANGER AND METHOD OF MAKING THE SAME

This is a divisional of application Ser. No. 08/132,337, filed Oct. 6, 1993, now U.S. Pat. No. 5,381,600.

BACKGROUND OF THE INVENTION

1. Field of the Invention

The present invention relates generally to heat exchangers, such as condensers for automotive vehicles. More particularly, the present invention relates to a condenser and a method for making the condenser wherein the internal diameter of the condenser tubing is deformed to a predetermined limit during the manufacture of the condenser.

2. Disclosure Information

Fin and tube type heat exchangers are commonly used in vehicle, industrial and residential environments for heating and Cooling purposes. Typically, these heat exchangers utilize a plurality of hairpin-shaped tubes to form a condenser or the like wherein the fluid passes through the plurality of tubes. The number of tubes depends upon the thermal capacity requirements of the fin and tube heat exchanger. Interleaved between the plurality of tubes are a plurality of stacked fin members which aid in dissipating the heat from the condenser as is well known in the art. A manifold interconnects the tubes so that fluid can flow therethrough.

To ensure good heat transfer between the tubes and the fins, there must be significant contact between the outer diameter of the tubes and the fins. In order to accomplish this, it is well known in the art to insert a bullet-like tool or expander plug into the heat transfer tube and displace the tool axially with respect to the tube to effect radial expansion of the tube into gripping engagement with the surrounding fins. It is also well known that one method to increase the thermal transfer coefficient of the tubing is to increase its internal surface area by providing surface irregularities therein. Typically, these irregularities are in the forms of grooves which, as shown in U.S. Pat. No. 3,517,536, are formed by inserting a bullet-like tool having cutting edges thereon which form grooves along the inner diameter of tube. Typically, the tool is rotated along the axial length of the tubing to form spiral grooves therein. However, because of tool wear during repeated expanding operations, the uniformity of the spiral grooves often changes and the efficiency of the heat exchanger decreases. It would, therefore, be advantageous to provide a method for making a heat exchanger wherein the internal surface irregularities of the tubing remains more uniform during the manufacturing process.

In most known manufacturing operations, the internal surface of the tubing is smooth prior to the insertion of the expander plug and the forming of the helical grooves therein. Prior to the present invention, it has not been known to expand the tubing wherein the surface irregularities are formed integral with the tube prior to the expansion process, and where the height of the surface irregularities are maintained to a specific height after expansion of the tubing to retain heat transfer characteristics.

SUMMARY OF THE INVENTION

The present invention overcomes the disadvantages associated with the prior art by providing a a heat exchanger, such as an automotive condenser for liquefying gaseous coolant comprising a manifold assembly, a plurality of generally longitudinal, separable stacked fin elements each having a pair of apertures disposed longitudinally therethrough, and a pair of support members disposed on opposite ends of said plurality of fin elements. The heat exchanger further comprises a plurality of tubular elements being disposed through said apertures and connected to the manifold assembly, each of said plurality of tubes having a corrugated cross-section comprising a plurality of projections and recesses disposed longitudinally in said tubes, said projections being formed during fabrication of said tubes to a first original height and being deformed to a second height of within 75% of the first original height during assembly of said heat exchanger.

It is an advantage of the present invention to improve the thermal transfer coefficient and characteristics of the heat exchanger by providing an extruded tube having a corrugated cross-section comprising a plurality of projections and recesses which are deformed a predetermined amount during the expansion of the tube process. These and other objects, features and advantages of the present invention will become apparent from the drawings, detailed description and claims which follow.

DETAILED DESCRIPTION OF THE PREFERRED EMBODIMENTS

Figure 1:
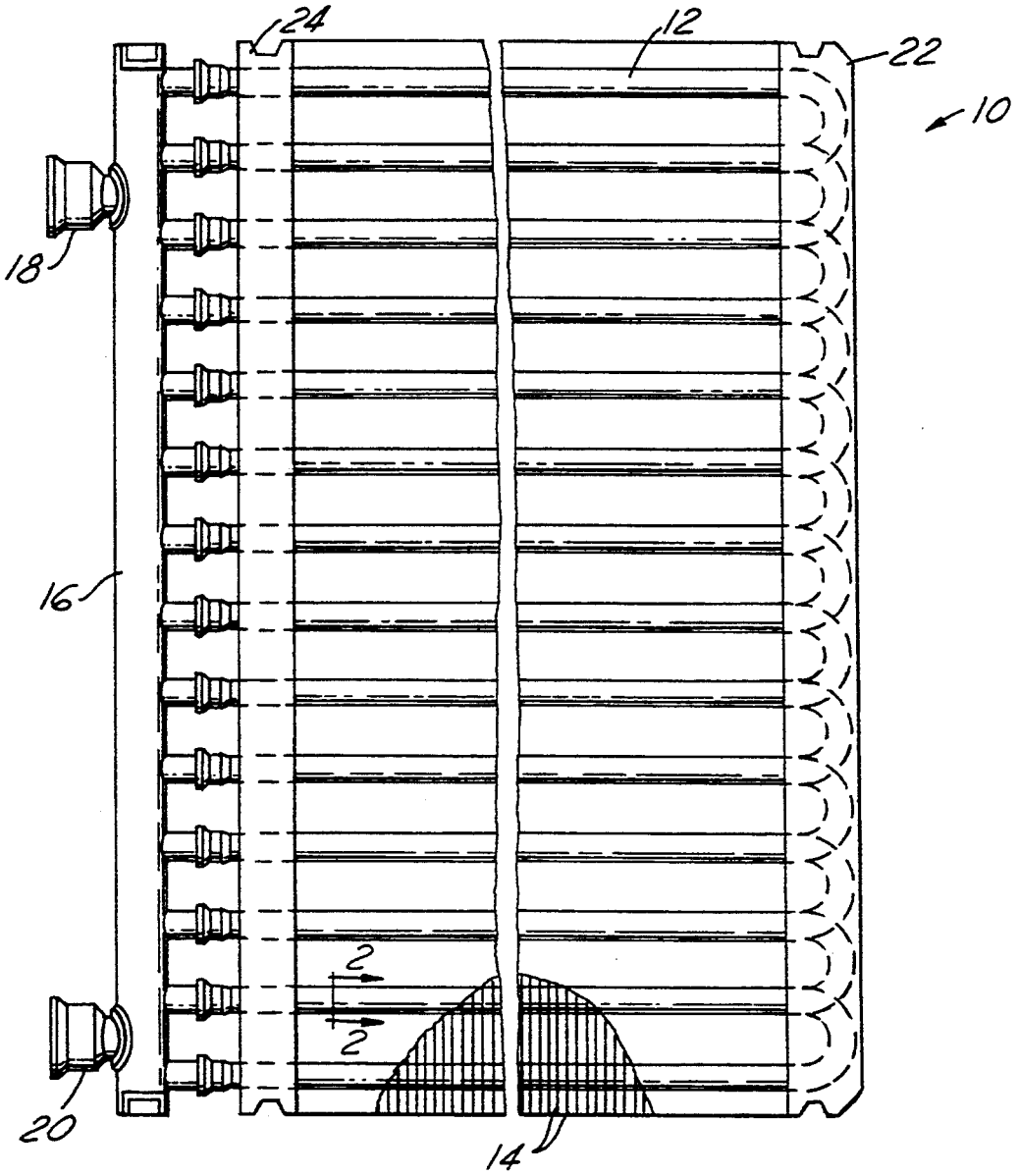
FIG. 1 is a perspective view of a tube and fin heat exchanger, such as an automotive condenser.

Referring now to the drawings, FIG. 1 shows a tube and fin heat exchanger, such as a condenser 10 including a plurality of hairpin-shaped tubes 12 with heat dissipative fins 14 interposed between each of the tubes. The free ends of the hairpin tubes 12 engage a manifold 16 disposed at one end of the heat exchanger 10. The manifold 16 can be any of a number of known configurations of manifolds, such as that disclosed in U.S. Pat. No. 5,190,101, assigned to the assignee of the present invention. As shown in the '101 patent, the manifold is a double-chamber manifold having a first and second fluid conduit, including an inlet port 18 for receiving fluid therein and an outlet port 20 for discharge of fluid therefrom. As further explained in the '101 patent, the manifold includes a plurality of baffles for directing the fluid through the heat exchanger according to a predefined pathway. In accordance with principles well known in the heat exchanger art, fluid to be cooled (or heated) enters the manifold through the inlet port 18 and is directed through the plurality of hairpin-shaped tubes 12 wherein the fluid is cooled by the secondary fluid, such as air passing over the fins 14. The baffles in the manifold direct the fluid through the hairpin tubes wherein the fluid eventually discharges from the outlet port 20. It should be apparent to those skilled in the art that the heat exchanger in FIG. 1 can utilize a manifold having a single fluid conduit or a multiple fluid conduit.

The present invention will be described herein with reference to the condenser 10 of FIG. 1. However, it will become apparent to those skilled in the art that the present invention can be utilized with other tube and fin heat exchangers, such as radiators and the like which use straight, not hairpin-shaped tubes, and fluid conduit assemblies, such as tanks in place of manifolds.

The condenser 10 further includes a pair of tube support members, such as endsheets 24, 22. One endsheet 24 is disposed adjacent the manifold while the second endsheet 22 is disposed at an opposite end of the condenser from the manifold 16. Each of the endsheets supports the tubes 12 and can further be utilized as attachment means for attaching the condensers to the vehicle. The endsheets 24, 22, are generally U-shaped members, having a planar base portion and a pair of flanges extending perpendicularly therefrom. The endsheets include a plurality of tube-receiving apertures therein.

Figure 2:
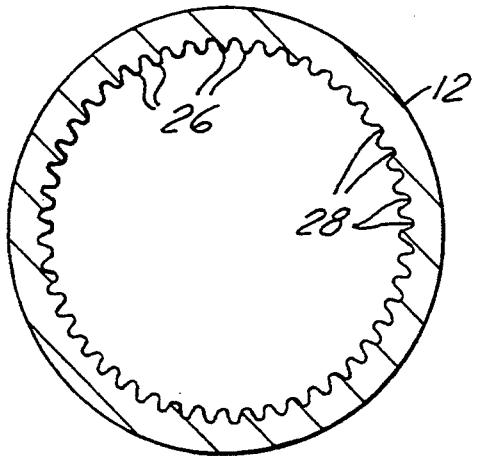
FIG. 2 is a cross-sectional view along line 2—2 of FIG. 1.

As shown in more detail in FIG. 2, each of the tubes 12 of the present invention includes a corrugated cross-section comprising a plurality of alternating projections 26 and recesses 28. The projections 26 are integrally formed with the tubing during an extrusion process and are typically formed of an aluminum alloy. The projections and recesses are disposed longitudinally along the longitudinal axis of the tubes. In this manner, the projections are not spiraled as is known in the prior art, but the present invention contemplates that they could be spiraled during the extrusion process. In the preferred embodiment, there are 48 projections per tube and the outer diameter of the tube is approximately 0.236 in. (6 mm). The thickness of the tube wall generally ranges between 0.0230–0.0220 inches with a projection height of between 0.005–0.010 inches prior to the expansion process of the present invention. As should be well known to those in the art, these values are merely examples and not meant to be limitations upon the present invention since these values can change depending upon the heat capacity requirements of the heat exchanger.

Figure 3:
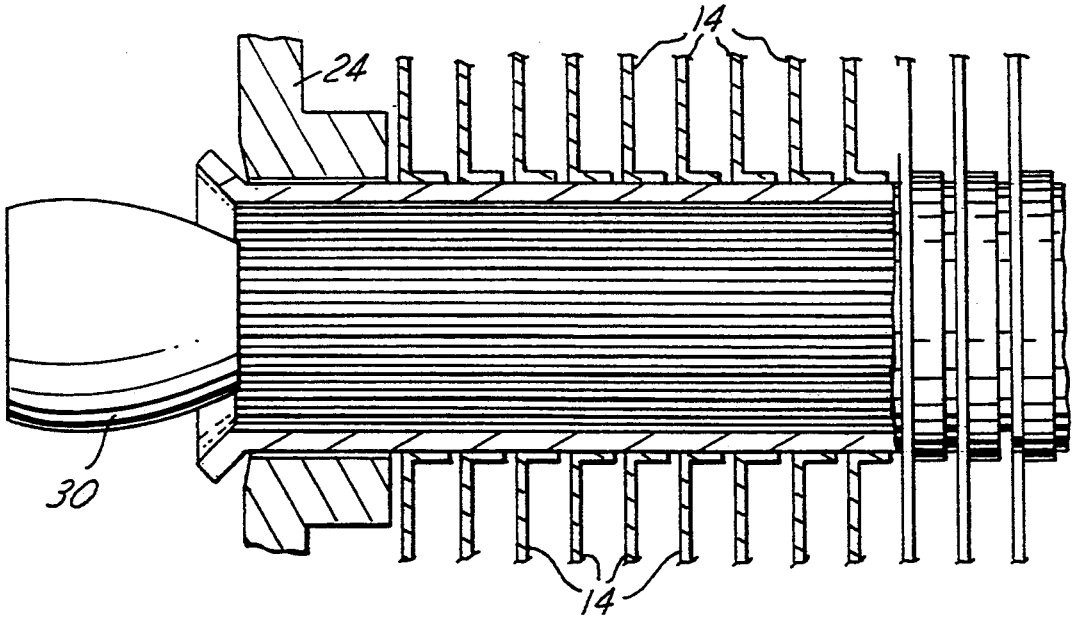
FIG. 3 is a cross-sectional view of a tube of a heat exchanger of the present invention and an expansion tool used during the method of the present invention.

FIG. 3 shows a cross-sectional view of a portion of the condenser 10 of FIG. 1 prior to expansion of the tube 12. The method of making a heat exchanger according to the present invention comprises the steps of first assembling a plurality of spaced, stacked fin members 14 on a first endsheet 22. Each of the fin members 14 includes a plurality of apertures extending longitudinally therethrough (not shown). Next, a plurality of hairpin tubes 16 having the corrugated internal diameter as described above are laced through each of the apertures in the respective stacked fin members so that the open ends of the tubes are positioned opposite the first endsheet 24. A second endsheet member 22 is then placed over the open ends of the tubes so that the tubes extend a predetermined distance therepast for later connection to the manifold assembly 16. The heat exchanger core is then fixed in a station so that the open ends of the tubes are proximate an expander tool 30 having a predetermined diameter. The expansion tool 30, such as an expansion bullet, has a tapered frustoconical configuration as shown in FIG. 3. To expand the tube 12 into mating contact with the fins 14 to provide for good heat transfer capacity, the expansion bullet 30 is forced through the internal diameter of the tube 12 along its axial length. The expansion bullet 30 must be of a predetermined diameter so as not to crush or deform the projections 26 beyond a predetermined limit or the heat transfer capacity of the tubing will be degraded. With this in mind, the diameter of the expansion bullet must be selected so that the height of the projections after deformation is within 75%–95% of the original height of the projections. In other words, the projections should not be deformed more than 25% of their original height. After a tube has been expanded, the expansion bullet 30 is removed and then placed to sequentially expand each of the remaining tubes in the heat exchanger core. Alternatively, all the tubes can be expanded simultaneously. When all of the tubes have been expanded, the manifold assembly 16 is connected to the open ends of the tubes through a welding operation, such as brazing or soldering at a predetermined temperature as is well known in the art to provide a completed heat exchanger.

Figure 4A:
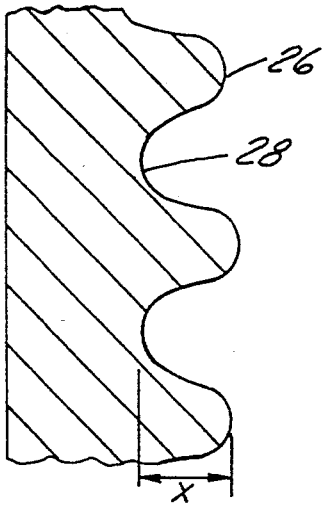
FIGS. 4(*a*) and (*b*) are cross-sectional views of the tubing of the present invention prior to and after the expansion of the tube according to the present invention.
Figure 4B:
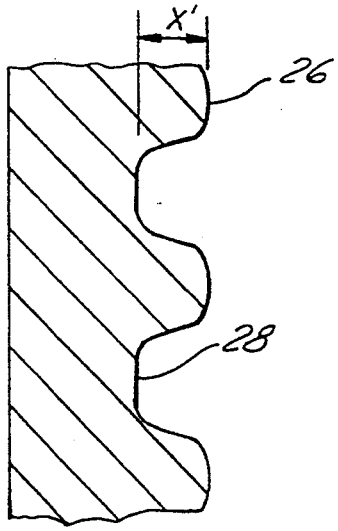

FIGS. 4(*a*) and 4(*b*) show a comparison of the cross-sectional view of the tubes 12 prior to and after the expansion bullet has been forced through the tube. In FIG. 4(*a*), the projections 26 are of uniform height and, as previously stated, have a height of between 0.005 and 0.010 inches. In FIG. 4(*b*), the expander bullet has passed over the projections 26' and as can be seen, the projections remain somewhat uniform in shape and have a slightly decreased height. Here the height of the projections 26 has been decreased to within 90–96% of its original height. As shown, the ratio of X'/X should be greater than 75% for maximum heat transfer characteristics. This still allows for excellent heat transfer capacity of the tube without losing any of the inherent benefits of the corrugated internal surface which were achieved previously. It is important that the projections 26 not be deformed beyond more than 75% of their original height or the heat transfer capacity of the tube is degraded.

In view of the above, variations and modifications to the present invention will, no doubt, occur to those skilled in the art. For example, the present invention has been described with reference to a condenser having hairpin-shaped tubes. However, the same principles of the present invention can be applied to different types of heat exchangers having parallel tubes or the like. It is the following claims, including all equivalents, which define the scope of the invention.

What is claimed is:

1. A heat exchanger for an automotive vehicle, comprising:

a manifold assembly;

a plurality of generally longitudinal, separable stacked fin elements each having a pair of apertures disposed longitudinally therethrough;

a pair of support members disposed on opposite ends of said plurality of fin elements;

a plurality of tubular elements being disposed through said apertures and connected to the manifold assembly, each of said plurality of tubes having a corrugated cross-section comprising a plurality of projections and recesses disposed longitudinally in said tubes, said projections being formed during fabrication of said tubes to a first original height and being deformed to a second height of within 75% of the first original height during assembly of said heat exchanger.

2. A heat exchanger according to claim 1, wherein each of said tubes are formed in an extrusion process and said projections and recesses are formed integral with the inner surface of said tube.

3. A heat exchanger according to claim 2, wherein each of said tubes are formed from an aluminum alloy.

4. A heat exchanger according to claim 3, wherein said heat exchanger is operative to condense gaseous coolant in an automotive air conditioning system.

* * * * *